US005832754A

United States Patent [19]

McKenzie

[11] Patent Number: 5,832,754

[45] Date of Patent: Nov. 10, 1998

[54] LOCKING DEVICE FOR SURFBOARDS

[76] Inventor: Dennis McKenzie, 122 Strand St., Apt. 2, Santa Monica, Calif. 90405

[21] Appl. No.: 416,991

[22] Filed: Apr. 5, 1995

[51] Int. Cl.[6] ..... E05B 69/00

[52] U.S. Cl. ..... 70/58; 70/14; 70/57

[58] Field of Search ..... 70/30, 49, 18, 70/14, 57, 58

[56] References Cited

U.S. PATENT DOCUMENTS

| | | | |
|---|---|---|---|
| 334,636 | 1/1886 | Bromley | 70/14 |
| 1,168,107 | 1/1916 | Oldham | 70/14 |
| 2,140,066 | 12/1938 | White | 70/14 |
| 2,567,069 | 9/1951 | Harley . | |
| 2,720,102 | 10/1955 | Spain | 70/14 |
| 2,969,993 | 1/1961 | Jasper | 70/203 |
| 3,423,968 | 1/1969 | Foote | 70/14 |
| 3,504,405 | 4/1970 | Elliott-Smith | 70/58 |
| 4,004,440 | 1/1977 | Dreyer | 70/58 |
| 4,267,615 | 5/1981 | Nealy | 411/347 |
| 4,300,371 | 11/1981 | Herwick et al. | 70/58 |
| 4,712,394 | 12/1987 | Bull . | |
| 4,820,220 | 4/1989 | Fruzetti et al. . | |
| 4,924,683 | 5/1990 | Derman . | |
| 4,938,040 | 7/1990 | Humphreys, Jr. . | |
| 5,007,256 | 4/1991 | Lowe | 70/58 |
| 5,119,649 | 6/1992 | Spence . | |
| 5,127,861 | 7/1992 | Ross . | |
| 5,199,916 | 4/1993 | Prickett . | |
| 5,327,752 | 7/1994 | Myers et al. . | |
| 5,351,507 | 10/1994 | Derman | 70/58 |

FOREIGN PATENT DOCUMENTS

| | | | |
|---|---|---|---|
| 3824393 | 7/1989 | Germany | 70/58 |
| 2109109 | 5/1983 | United Kingdom | 70/233 |

OTHER PUBLICATIONS

Surf Lock, Author Unknown, Admitted Prior Art.

*Primary Examiner*—Darnell M. Boucher
*Attorney, Agent, or Firm*—R. Joseph Trojan

[57] ABSTRACT

A surfboard locking mechanism for use with having a plug with a bottom surface that is substantially planar and may have a notch formed in an edge of said bottom surface, the plug including locking means for engaging a ratchet blade passing through said plug, the blade having means for engaging a cross bar within a recessed cup in surfboard, and a cable secured to the blade for attaching to a stationary object whereby the plug is substantially flush with the top surface of the surfboard and covers the recessed cup when in a locked position.

4 Claims, 2 Drawing Sheets

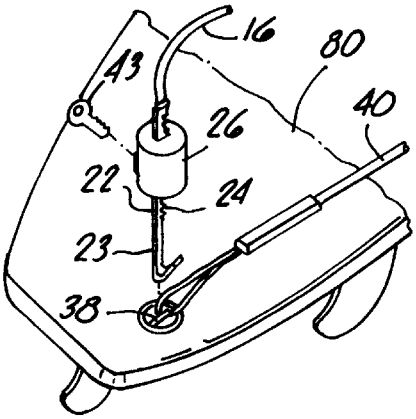
FIG. 2.
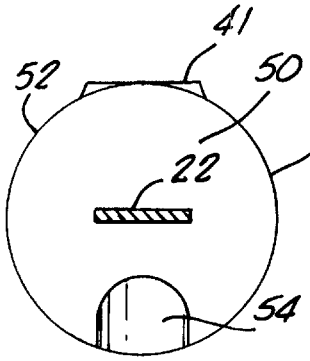
FIG. 7.
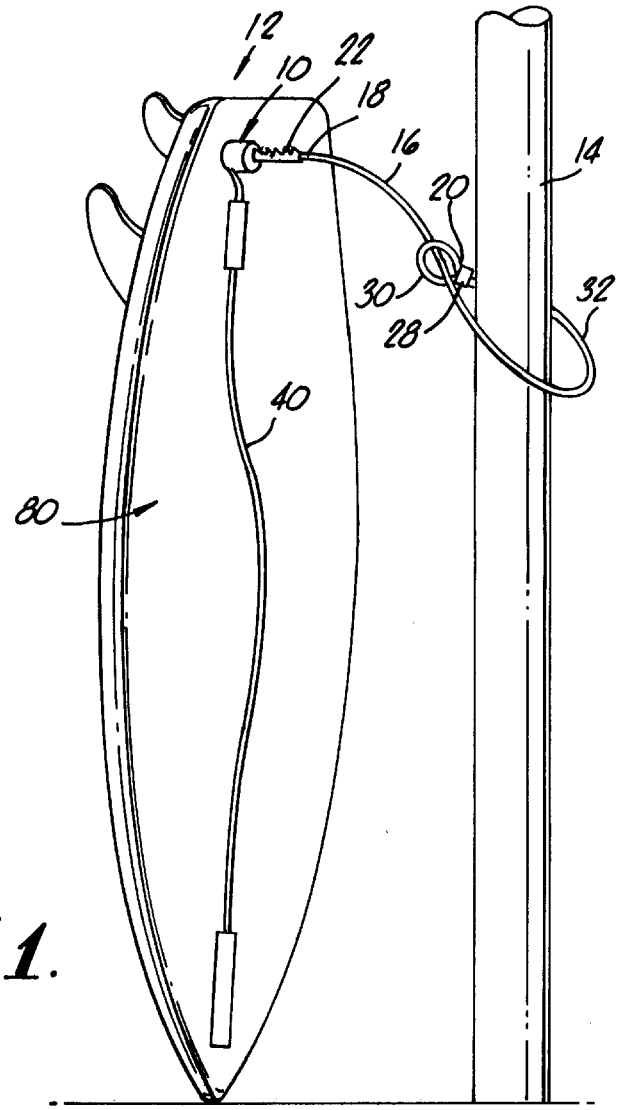
FIG. 1.
FIG. 3.
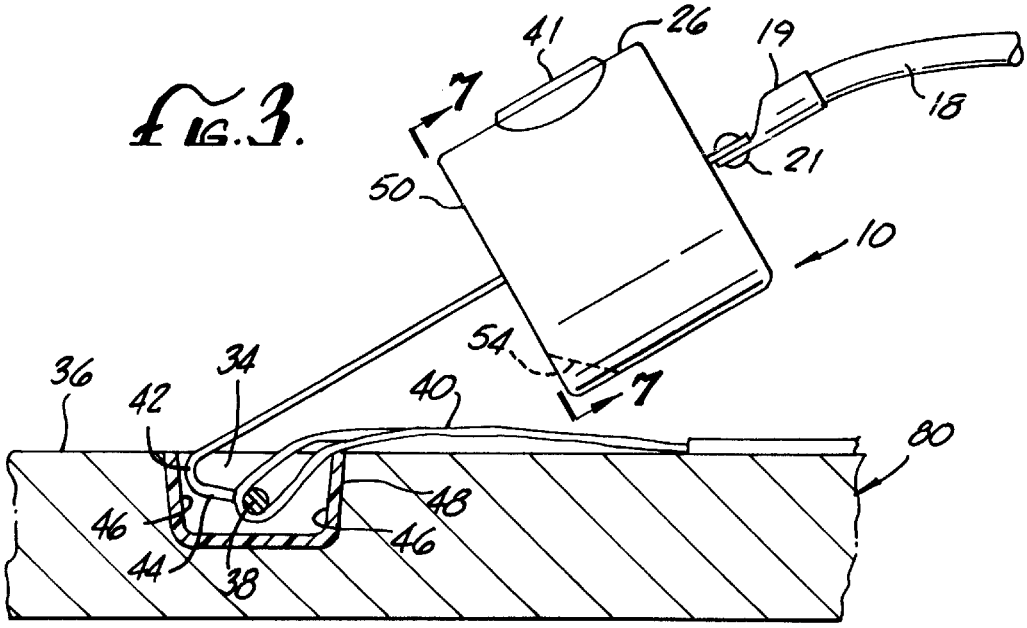

LOCKING DEVICE FOR SURFBOARDS

BACKGROUND OF THE INVENTION

1. Field of the Invention

This invention relates to locking devices for surfboards.

2. Background of the Invention

The sport of surfing has become very popular and the value of surfboards has increased accordingly. A typical surfboard can easily cost $800 to a $1,000. Consequently, the value and portability of surfboards make them desirable targets for theft. Furthermore, the structure and size of surfboards prevents users from securing their boards so that they can take part in the many other activities available at the beach. A surfboard is too big to lock in a car. The board can get wet and covered in sand so even owners of large sport vehicles are unlikely to dirty their vehicles to protect their property. Finally, the structure of the boards is such that few surfaces avail themselves to locking them up.

A number of locking devices have been developed to prevent the theft of surfboards. However, they present numerous disadvantages to the user. The Fruzetti et. al. patent (U.S. Pat. No. 4,820,220) employs the ankle tether commonly found on surf boards to secure the board to stationary objects. However, the ankle tether is typically a lightweight material such as nylon. A thief would need no more than a pocket knife to cut through the tether to steal the board.

Also, the Fruzetti patent, the Ross patent (U.S. Pat. No. 5,127,861) and the Bull patent (U.S. Pat. No. 4,712,394) are not manufactured with surfboards so they involve retrofitting. The drawback to this type of alteration of surfboards is that the common surfboard is made of rigid lightweight materials such as fiberglass that can be brittle when the body of the board is cracked. Retrofitting can cause the cracking and splitting of the fiberglass layers. Thus, the owner of a common surfboard would have to damage the surfboard in order to protect it.

The Humphreys, Jr. patent (U.S. Pat. No. 4,938,040) and the Spence patent (U.S. Pat. No. 5,119,649) each uses normal padlocks to secure hooks placed around the leash cup cross bar found on most surfboards. However, as stated above, surfboards are valuable items of sometimes brittle material. The padlocks, when attached, hang loose on the surfboard and can rattle about on the surface of the board, causing wear and tear on the surfboard and possibly damage. Furthermore, the padlock, when unattached, is a loose item that can be easily be lost and separated from the cable, hook and board. This is especially true in the beach setting where loose items can easily become buried in the sand.

Finally, one of the preferred versions of the Spence patent embodies the lock, cable and hook attachment in a single device. This does eliminate the problem of losing the padlock as mentioned above. However, the resulting body of the lock is bulky and cumbersome when attached to the surfboard. No space exists for the leash so the body of the lock rubs the leash against the board and causes wear and tear. Also, the lock relies on the key to engage the lock. Thus, the process of engaging the lock is cumbersome too.

A common draw back among all the prior art devices involves their interaction with the recessed cup that contains the cross bar. The cup and cross bar are typically installed by forming a recess in the surfboard. A plastic cup is inserted into the recess and glued into place. The cross bar is mounted into opposing sides of the cup. The prior art locking devices are secured to the cross bar. The problem with this approach is that the locking device can be circumvented merely by prying the cup out of the recess with a screw driver and taking off with the freed surf board. While this causes some damage to the board, the thief can repair the damage in his lair at his leisure.

Hence, a need exists for a small simple locking device, readily and quickly attachable to conventional surfboards, that will not damage the boards when attached and will not be easily circumvented by prying the cup out of the recess in the surfboard.

SUMMARY OF THE INVENTION

The present invention is directed to a surfboard lock that satisfies the needs identified above: easily attachable to conventional surfboards without retrofitting. The invention is an improvement over the prior art because it involves a single mechanism so that pieces are not lost, it prevents a common practice among surfboard thieves of prying off the recessed cup, it includes a durable lock cable that prevents theft, and a lock that will engage without the key for quick and easy security.

The preferred version of the invention comprises: i) a cable with a loop on one end and the lock on the other; ii) a slide that allows the lock to be adjusted to cover the recess and secured without the key or combination; iii) a plug large enough to cover the entire recess and lay flush against the surfboard; iv) a hook that will anchor the lock to the leash plug crossbar; and v) a notch to allow the tether or leash to hang out of the recess without undue wear and tear.

The lock allows a user to wrap the cable around a stationary object and thread the lock through the loop to create a slip knot with the cable. The hook is then anchored to the cross bar and the plug is slid down the ratchet blade into place over the leash plug and flush with the surface of the board. This allows the user to lock the surfboard almost anywhere there is a fixed object without fear of theft and without the possibility of damaging the board with the lock itself.

These and other objects and advantages of the present invention will become apparent from the following detailed description of the preferred embodiment of the invention without intending to limit the scope of the invention which is set forth in the appended claims.

DETAILED DESCRIPTION OF THE DRAWINGS

The advantages of the invention can be more clearly understood by reference to the drawings in which:

FIG. 1 is a view of the invention in use.

FIG. 2 is a rotated perspective view of the invention disengaged.

FIG. 3 is a side view of the invention applied to a cross-sectional view of a surfboard.

FIG. 7 is a bottom axial view.

DETAILED DESCRIPTION OF THE PREFERRED EMBODIMENT

Figure 4:
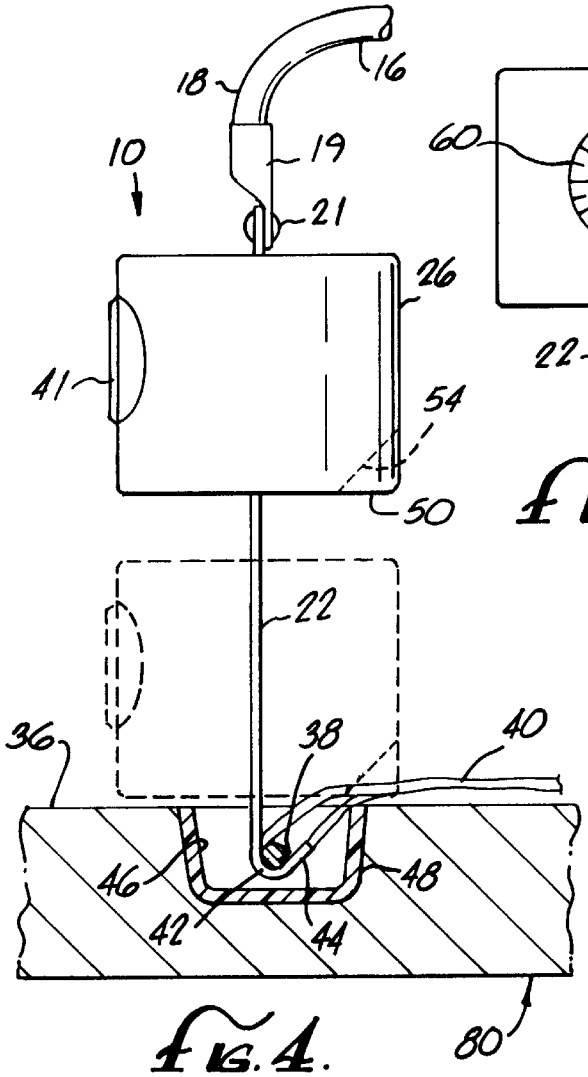
FIG. 4 and FIG. 5 are side views of the invention unlocked (FIG. 4) and locked (FIG. 5).

FIG. 1 illustrates the present invention 10, a surfboard locking device, securing a surfboard 12 to a stationary object 14. The locking device 10 includes a cable 16 having a first end 18 and a second end 20. The cabling 16 should be made of strong material that resists cutting and deterioration such as metal cabling covered with plastic. The first end 18 of the cable 16 is secured to a ratchet blade 22 having an edge 23, which includes teeth 24. The ratchet blade 22 can be secured to the cable by any appropriate means. The inventor has found it useful to use a metal terminal crimp 19 secured to the ratchet blade 22 by a hinge 21. In the preferred embodiment, the ratchet blade 22 is approximately four and three-eights inches long and a half inch wide. The teeth 24 can extend along the entire edge 23 of the blade 22 or any shorter length that will still engage the lock. However, the inventor prefers for the teeth 24 to extend along the edge 23 for approximately 70% of the total length of the blade 22. However, the ratchet blade 22 may also be a rod having recesses for slideably engaging a locking means or any other construction that permits the blade 22 to pass through the plug and slideably engage a locking mechanism.

To understand the remaining features of the ratchet blade 22 requires that we briefly digress to explain one of the common features of surfboards. Most surfboards typically include a circular recess 34 within their top surface 36. The recess 34 is usually formed by carving it out of the surfboard and inserting a cup 48 in the recess 34, which is typically made out of plastic and glued into place. The cup 48 has a circular inner wall 46 and typically contains a rod 38, which is mounted within the recess 34 by imbedding each end of the rod 38 within the circular inner wall 46. The rod 38 is usually about one-eighth of an inch in diameter. The purpose of the rod 38 is to have a means of securing a tether line 40 to the surfboard 12, which can be secured to the ankle of the surfer to keep the two from parting company. The invention takes advantage of these existing features in the following manner:

The ratchet blade 22 has a hooked end 42, which includes a lip 44. To operate properly, the hooked end 42 must conform to certain specific criteria. Namely, the lip 44 must be sufficiently short so as to fit between the rod 38 and the inner wall 46 during installation as shown in FIG. 3. But the lip 44 must be sufficiently long so that the hooked end 42 will not slip off the cross bar 38 during operation. As a practical matter, there are various sized recesses 34 used with surf boards on the market. Therefore, the limiting factor for the present invention must be defined by the smallest recess 34 on the market, which is approximately one inch in diameter. As a result, the lip 44 in the preferred embodiment should not be more than approximately three-eighths inches in length, but no shorter than approximately two-eighths inches. However, the invention can work outside of this range depending upon the size of the recess 34 and the size of the cross bar 38. The ratchet blade 22 and lip 44 are preferably made of 100% grade A tool steel, which has been case hardened and chrome plated to protect against salt water corrosion.

Figure 5:
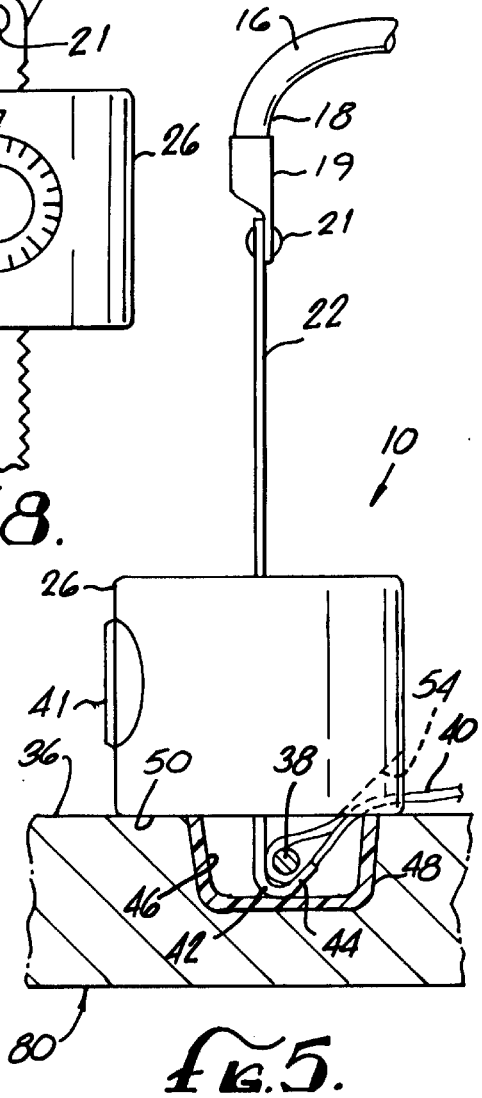

One of the key features of the invention involves the construction of a plug 26. As shown in FIG. 2, the ratchet blade 22 passes through the plug 26. A conventional locking mechanism is located within the plug 26 and engages the teeth 24 of the ratchet blade 22 to lock the plug 26 in place. The plug 26 includes a bottom surface 50 having a bottom edge 52. In the preferred embodiment, the bottom surface 50 is substantially planar so that it can be substantially flush with the top surface 36 of the surfboard 12 in the locked position as shown in FIG. 5. The bottom surface 50 must also be sufficiently large to completely cover the recess 34. By completely covering the recess 34, it prevents thieves from prying the cup 48 out of the recess 34, which is how prior art surfboard locking mechanisms have been circumvented. In the case of a cup 48 having an outer diameter of approximately 1.25 inches, the bottom surface 50 of the plug 26 should have an diameter of approximately 1.75 inches. In the preferred embodiment, these relative dimensions should be followed.

If the shape of the recess 34 or cup 48 has been modified, then the shape of the bottom surface 50 of the plug 26 should be adapted to accommodate the modification. For example, if the cup 48 is rectangular, then the maximum diameter of the bottom surface 50 of the plug 26 should be greater than the maximum diameter of the rectangle (i.e., greater than the length of the rectangle). This insures the bottom surface 50 of the plug 26 always covers the cup 48.

But regardless of the specific construction of the bottom surface 50, at least the edge 52 of the bottom surface 50 must be substantially flush with the top surface 36 of the surfboard 12. By insuring that at least the edge 52 is flush, a similar result can be achieved. The plug 26 should be constructed of a hard, durable material that cannot be easily deformed, by a would-be thief seeking to gain access with a screw driver to the cup 48. Suitable materials include metals, epoxy, or polycarbonate plastic, and/or high density polyethylene.

An important feature of the plug 26 is a notch 54 located in the bottom edge 52 of the plug 26. The notch 54 provides room for the tether 40 so that the tether does not hinder the ability of the bottom surface 50 or edge 52 to lie flush with the top surface 36 of the surfboard 12 as shown in FIG. 5, which is important for the reasons stated above. It would be a significant inconvenience if the surfer had to disconnect the tether to effectively use the present invention. Hence, the notch 54 provides an important advantage for the user.

The second end 20 of the cable 16 can be folded back and secured to the cable 16 using a conventional crimping means 28 thereby forming a loop 30. The loop 30 must be of sufficient diameter to permit the plug 26 to pass through the loop 30. The plug 26 and ratchet blade 22 are passed through the loop 30 prior to securing the invention to the surfboard 12. This creates a slip knot 32 around the stationary object 14 to prevent the theft of the surfboard 12.

As shown in FIG. 3, the hook 42 slips over the cross bar 38 to secure the lock 10 to the board 12. Then, as shown in FIGS. 4 and 5, the plug 26 is adjusted down the ratchet blade 22 to fit flush against the surface of the surfboard 12. The teeth 24 of the ratchet blade 22 interact with the key lock 41 so that, as is shown, securing the plug 26 to the board 12 does not require a key 43.

Figure 8:
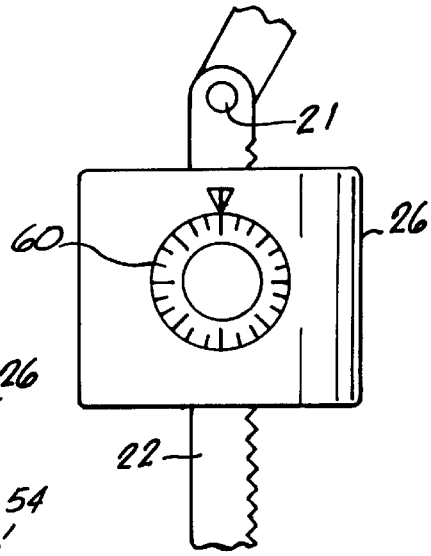
FIG. 8 is one version of the invention where the lock is a combination lock.
Figure 6:
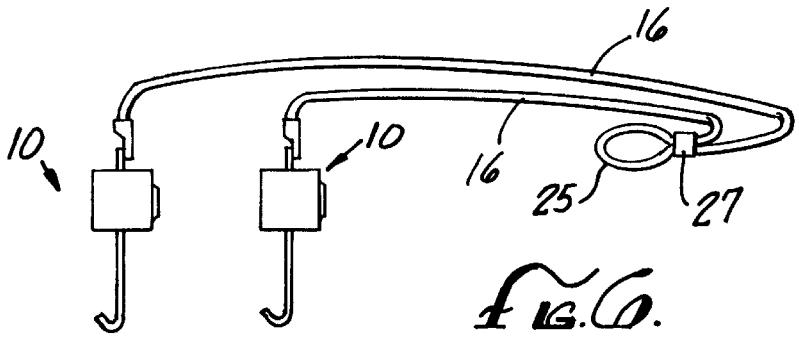
FIG. 6 is one version of the invention where two locks are connected to a single loop.

Although the present invention has been described in considerable detail with reference to certain preferred versions thereof, other versions are possible. For example, as stated above, the key lock 41 could be replaced with a combination lock 60 that can be disengaged by entering a series of letters or numbers as is shown in FIG. 8. A combination lock would provide the additional advantage of not having a key that could be easily lost at the beach. Also, a loop 25 and a crimp can be attached to a plurality of locking cables 16 and plugs 26 so that several activity boards can be secured together as is shown in FIG. 6. Therefore, the spirit and scope of the appended claims should not be limited to the description of the preferred versions contained herein.

What is claimed is:

1. A locking mechanism for surfboards, said surfboards having a substantially planar top surface wherein said top surface includes a recessed cup containing a cross bar, and a leash attached to said cross bar, the locking mechanism for surfboards comprising:

a plug having a bottom surface, a locking means contained within said plug, and a groove extending through said plug to accommodate a ratchet blade;

said bottom surface including a bottom edge, said edge being substantially planar so that said edge is flush against said top surface of said surfboard when said locking mechanism is in a locked position, said edge including at least one notch means formed in a portion of said edge and having a depth sufficient for allowing the passage of said leash without hindering flush mounting of the remainder of the edge of the locking mechanism to the top surface of the surfboard;

said notch means being space from the groove on the bottom surface;

said ratchet blade passing through said plug and slideably engaging said locking means, said blade having a first end and a second end, said first end having a hook for engaging said cross bar;

a cable secured to said second end of said blade; and, whereby said edge of said plug is substantially flush with said top surface of said surfboard and covers said recessed cup, yet allowing said leash to pass through said notch, when in a locked position.

2. A locking mechanism for surfboards as in claim 1 wherein said ratchet blade includes teeth that engage said locking means.

3. A locking mechanism for surfboards as in claim 1 wherein said locking means further comprises a means for disengaging the lock by entering a combination of numbers or letters into said locking means and a means for engaging the locking means without use of a key or said combination of numbers or letters.

4. A locking machanism for surfboards as in claim 1 wherein the locking means further comprises means for engaging the locking means without use of a key and means for opening the locking means with a key.

* * * * *